US011173499B2

(12) United States Patent
Chen

(10) Patent No.: US 11,173,499 B2
(45) Date of Patent: Nov. 16, 2021

(54) ELECTRIC FIELD DEVICE WITH AUTOMATIC CLEANING FUNCTION

(71) Applicant: Shenzhen Shenyaneng Environmental Protection Technologies Co., Ltd., Shenzhen (CN)

(72) Inventor: Yajun Chen, Shenzhen (CN)

(73) Assignee: SHENZHEN SHENYANENG ENVIRONMENTAL PROTECTION TECHNOLOGIES CO., LTD., Shenzhen (CN)

( * ) Notice: Subject to any disclaimer, the term of this patent is extended or adjusted under 35 U.S.C. 154(b) by 351 days.

(21) Appl. No.: 16/340,121

(22) PCT Filed: Nov. 20, 2017

(86) PCT No.: PCT/CN2017/111839
§ 371 (c)(1),
(2) Date: Apr. 7, 2019

(87) PCT Pub. No.: WO2018/090990
PCT Pub. Date: May 24, 2018

(65) Prior Publication Data

US 2020/0009579 A1 Jan. 9, 2020

(30) Foreign Application Priority Data

Nov. 21, 2016 (CN) ..... 201611020836.3

(51) Int. Cl.
*B03C 3/74* (2006.01)
*B03C 3/04* (2006.01)
*B03C 3/49* (2006.01)

(52) U.S. Cl.
CPC ..... *B03C 3/743* (2013.01); *B03C 3/04* (2013.01); *B03C 3/49* (2013.01)

(58) Field of Classification Search
CPC combination set(s) only.
See application file for complete search history.

(56) References Cited

U.S. PATENT DOCUMENTS 1,412,248 A * 4/1922 Laughlin ..... B03C 3/743 96/25
2020/0368757 A1* 11/2020 Lee ..... B03C 3/08

FOREIGN PATENT DOCUMENTS

CN 102000683 A 4/2011
CN 202366787 U 8/2012
(Continued)

OTHER PUBLICATIONS

Search Report of PCT/CN2017/111839.
(Continued)

*Primary Examiner* — Christopher P Jones
*Assistant Examiner* — Sonji Turner
(74) *Attorney, Agent, or Firm* — Dragon Sun Law Firm, PC; Jinggao Li, Esq.

(57) ABSTRACT

The present invention discloses an electric field device with an automatic cleaning function, which includes a support, at least one hollow cylindrical dust collecting electrode, and a corona pole placed on a central axis of the hollow cylindrical dust collecting electrode, wherein an end part of the corona pole is fixed on the support, the dust collecting electrode is grounded, and the corona pole is connected to a power source; and the present invention further includes a wind wheel, an axle hole of the wind wheel is provided with an internal thread, the corona pole is provided with an external thread matched with the internal thread on the wind wheel, and a periphery of the wind wheel is provided with a dust sweeping device in contact with an inner wall of the hollow
(Continued)

cylindrical dust collecting electrode. The electric field device does not require manual cleaning, thus saving time and costs.

12 Claims, 1 Drawing Sheet

(56) References Cited

FOREIGN PATENT DOCUMENTS

| | | | | | |
|---|---|---|---|---|---|
| CN | 103447152 | A | | 12/2013 | |
| CN | 204429802 | U | | 7/2015 | |
| CN | 104832980 | A | | 8/2015 | |
| CN | 106733198 | A | | 5/2017 | |
| CN | 206304905 | U | | 7/2017 | |
| DE | 3626002 | A | * | 2/1988 | ..... B03C 3/12 |
| EP | 1038582 | A1 | | 9/2000 | |

OTHER PUBLICATIONS

Written opinion of PCT/CN2017/111839.
RO 101 of PCT/CN2017/111839.
First office action of CN201611020836.3.

* cited by examiner

ELECTRIC FIELD DEVICE WITH AUTOMATIC CLEANING FUNCTION

CROSS-REFERENCE TO RELATED APPLICATIONS

This application is a national stage application of PCT Application No. PCT/CN2017/111,839. This Application claims priority from PCT Application No. PCT/CN2017/111,839, filed Nov. 20, 2017, and CN Application No. 201611020836.3, filed Nov. 21, 2016, the content of which is incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the present disclosure described herein. All references cited and discussed in this specification are incorporated herein by reference in their entireties and to the same extent as if each reference was individually incorporated by reference.

TECHNICAL FIELD

The present invention relates to the technical field of electric field device in electrostatic precipitator, and more particularly, to an electric field device with an automatic cleaning function.

BACKGROUND

In recent years, the problem of air pollution has become increasingly prominent, and the treatment of fine particulate matter (such as PM2.5) pollutants has attracted more and more attention. The electrostatic precipitator is widely used to purify waste dust and waste gas due to the high dust removal efficiency, simple structure, low material consumption and low cost.

The working principle of the electrostatic precipitator is that: when gas containing dust particles passes through a high-voltage electric field formed between a cathode wire (corona wire) connected to a high-voltage DC power supply and a grounded anode plate (dust collecting electrode), the gas is ionized due to corona discharge of a cathode. At the moment, negatively charged gas ions move towards the anode plate under the action of an electric field force, and collide with the dust particles during the movement, so that the dust particles are negatively charged, and the charged dust particles also move towards an anode under the action of the electric field force, and release electrons after reaching the anode, and the dust particles are deposited on the anode plate, so that purified gas is discharged out of the precipitator.

The existing electrostatic precipitator cleans the collected dry dust by knocking, but it can't do anything about viscous waste gas (such as oil and asphalt smoke). Generally, the electric field device is cleaned by manual cleaning, which is time-consuming and laborious and has high maintenance cost. In the prior art, a small part of electric field devices are cleaned by spraying solution water or the whole electric field is soaked in the solution for cleaning. For example, an electric field cleaning method and device for electrostatic oil fume evolution device is disclosed in a Chinese patent with an application No. 201310258820.6, and an industrial oil fume cleaning device capable of on-line self-cleaning is disclosed in a Chinese patent with an application No. 201210262247.1, and in the technologies above, the electric field device is not completely cleaned, the water consumption is huge, and it is easy to cause secondary pollution. Moreover, since each cleaning is not complete, the pollutant become dry and hard, which is more and more difficult to clean, and finally manual cleaning is required.

Therefore, how to provide a self-cleaning electric field device is an urgent problem in the industry. Accordingly, a heretofore unaddressed need exists in the art to address the aforementioned deficiencies and inadequacies.

SUMMARY

The technical problem to be solved by the present invention is to provide an electric field device with an automatic cleaning function, which does not require manual cleaning, thus saving time and costs.

The technical solution of the present invention is as follows: an electric field device with an automatic cleaning function comprises a support, at least one hollow cylindrical dust collecting electrode, and a corona pole placed on a central axis of the hollow cylindrical dust collecting electrode, wherein an end part of the corona pole is fixed on the support, the dust collecting electrode is grounded, and the corona pole is connected to a power source; and the electric field device with an automatic cleaning function further comprises a wind wheel, an axle hole of the wind wheel is provided with an internal thread, the corona pole is provided with an external thread matched with the internal thread on the wind wheel, and a periphery of the wind wheel is provided with a dust sweeping device in contact with an inner wall of the hollow cylindrical dust collecting electrode.

The dust sweeping device is a brush or a scraper.

The hollow cylindrical dust collecting electrode is a hollow circular cylinder dust collecting electrode or a hollow prismatic dust collecting electrode.

One hollow cylindrical dust collecting electrode is arranged.

Two or more hollow cylindrical dust collecting electrodes are arranged, and at least one ends of the two or more hollow cylindrical dust collecting electrodes are connected into a whole through a patch plate.

The hollow cylindrical dust collecting electrode is formed by connecting two dust collecting plates respectively provided with a groove.

A shape of the groove is a semicircle or a half of a polygon.

According to the electric field device with an automatic cleaning function provided by the present invention, the axle hole of the wind wheel is provided with the internal thread, the corona pole is provided with the external thread matched with the internal thread on the wind wheel, and the periphery of the wind wheel is provided with the dust sweeping device, in this way, when the waste gas passes through the electric field device, an airflow drives the wind wheel to rotate, and the wind wheel moves up and down along the corona pole while rotating, so that the wind wheel passes through the inside of the hollow cylindrical dust collecting electrode. At the moment, the dust sweeping device on the wind wheel follows the rotation of the wind wheel to clean the dust on the inner wall of the dust collecting electrode, so that the electric field device has the automatic cleaning function, and cleans the dust on the inner wall of the dust collecting electrode while removing the dust in the airflow, without needing manual cleaning, thus saving time and costs.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

DETAILED DESCRIPTION OF THE PREFERRED EMBODIMENTS

Figure 1:
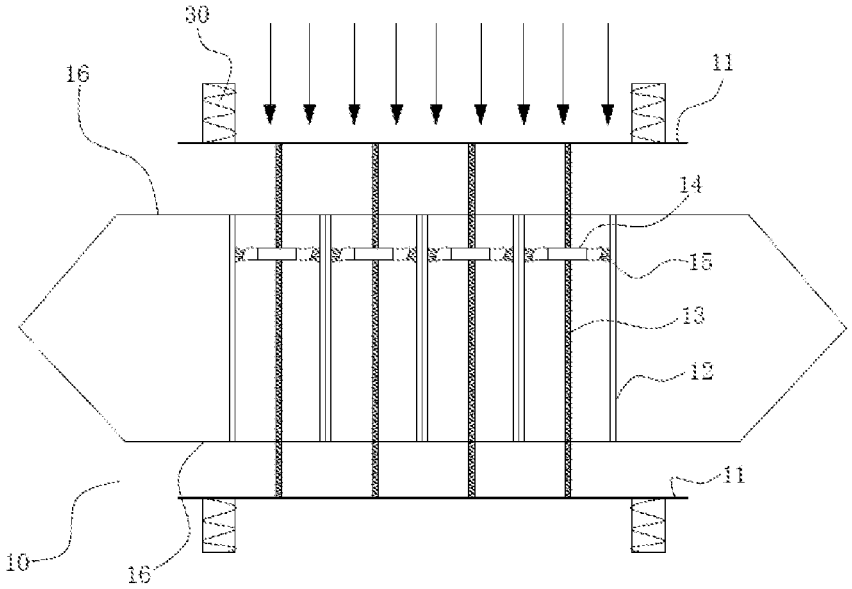
FIG. 1 is a structure diagram of an electric field device of the present invention.
Figure 2:
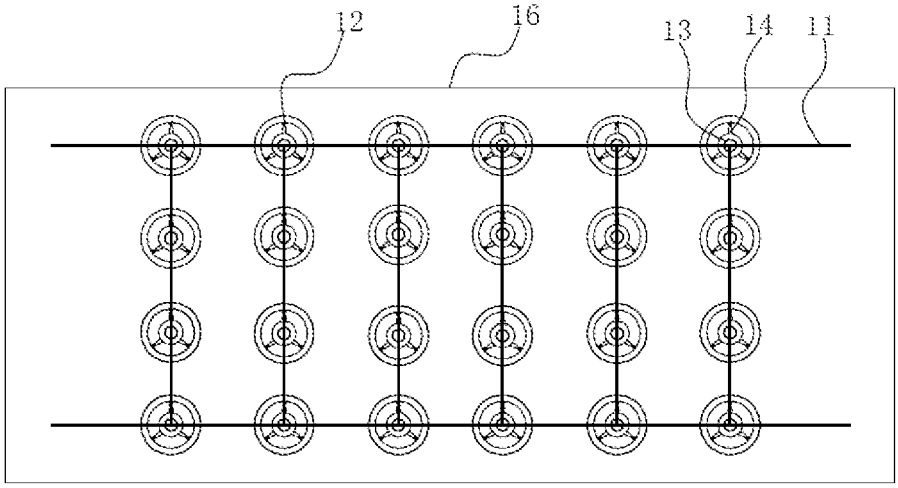
FIG. 2 is a structure diagram of the electric field device of the present invention from top to bottom.

As shown in FIG. 1 and FIG. 2, the present invention provides an electric field device with an automatic cleaning function, the electric field device 10 comprises a support 11, at least one hollow cylindrical dust collecting electrode 12, and a corona pole 13 placed on a central axis of the hollow cylindrical dust collecting electrode 12, and an end part of the corona pole 13 is fixed on the support 11. One or two supports 11 may be arranged. Two supports 11 arranged in the embodiment, the hollow cylindrical dust collecting electrode 12 is arranged between the two supports 11, and two end parts of the corona pole 13 are respectively fixed on the two supports 11. The dust collecting electrode 12 is grounded, and the corona pole 13 is connected to a power source. In the embodiment, the support can be a metal conductive support or a metal plated plastic support, or a non-conductive support. If the support is the metal conductive support or the metal plated plastic support, the supported is connected to the power source; and if the support is the non-conductive support, each corona pole needs to be connected before connecting to the power source. In the actual production, the support is the metal conductive support. The support is fixed on a housing (not shown in the drawing) of the electrostatic precipitator through an insulating device 30.

The electric field device further comprises a wind wheel 14, and an axle hole of the wind wheel 14 is provided with an internal thread. The corona pole 13 is provided with an external thread matched with the internal thread on the wind wheel 14. A periphery of the wind wheel 14 is provided with a dust sweeping device 15 in contact with an inner wall of the hollow cylindrical dust collecting electrode. When waste gas (with dust or oil pollutant) passes through the electric field device 12, an airflow drives the wind wheel 14 to rotate, and the wind wheel 14 moves up and down along the corona pole 13 while rotating, so that the wind wheel 14 passes through the hollow cylindrical dust collecting electrode 12. At the moment, the dust sweeping device 15 on the wind wheel 14 follows the rotation of the wind wheel 14 to clean the dust on the inner wall of the dust collecting electrode. The cleaned dust flows out from a dust hopper opening arranged at a bottom part of the housing.

When the wind wheel is initially installed on the corona pole, the wind wheel is located above or below the dust collecting electrode.

In the embodiment, the dust sweeping device 15 is a brush or a scraper, and the example in FIG. 1 and FIG. 2 is the brush. In addition, only one wind wheel 14 may be installed on the corona pole 13.

The hollow cylindrical dust collecting electrode is a hollow circular cylinder dust collecting electrode or a hollow prismatic dust collecting electrode in the embodiment, the hollow cylindrical dust collecting electrode is preferably the hollow circular cylinder dust collecting electrode, an outer diameter of the wind wheel is smaller than an inner diameter of the hollow circular cylinder dust collecting electrode, so that after the brush or the scraper is installed on the periphery of the wind wheel, the brush or the scraper is contacted with the inner wall of the dust collecting electrode.

As shown in FIG. 2, in the embodiment, two or more hollow cylindrical dust collecting electrodes 12 are arranged, and at least one ends of the two or more hollow cylindrical dust collecting electrodes 12 are connected into a whole through a patch plate 16, that is, a gap between the dust collecting electrodes is filled up with the patch plate, so that the waste gas can only pass through an inside of the dust collecting electrode, and purification with maximum efficiency is realized. In the embodiment, two ends of the two or more hollow cylindrical dust collecting electrodes 12 are respectively connected into a whole through the patch plate 16. In the embodiment, the patch plate is made of metal.

One hollow cylindrical dust collecting electrode may also be arranged.

As shown in FIG. 1, when the waste gas passes through the electric field device from top to bottom, the airflow drives the wind wheel to rotate while moving downwards along the corona pole, and when the wind wheel moves to the inside of the hollow cylindrical dust collecting electrode, the brush or the scraper follows the wind wheel to rotate to clean the dust on the inner wall of the dust collecting electrode. When the waste gas passes through the electric field device from bottom to top, the airflow drives the wind wheel to rotate while moving upwards along the corona pole, and when the wind wheel moves to the inside of the hollow cylindrical dust collecting electrode, the brush or the scraper follows the wind wheel to rotate to clean the dust on the inner wall of the dust collecting electrode. Changing a direction of the airflow passing through the electric field device can enable the wind wheel to move back and forth on the corona pole, so that the dust on the inner wall of the dust collecting electrode can be thoroughly cleaned.

Figure 3:
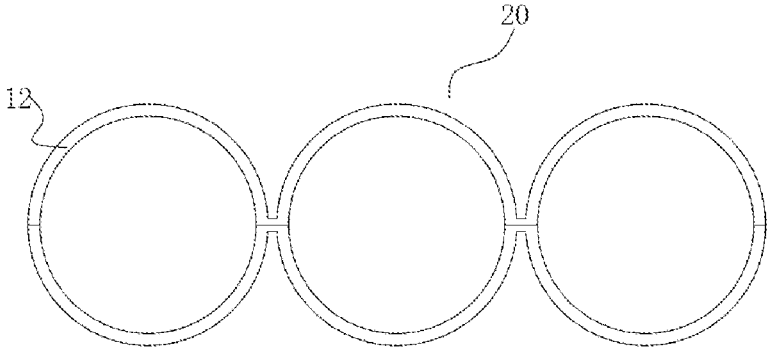
FIG. 3 is a constitution diagram of a hollow cylindrical dust collecting electrode in another embodiment of the present invention.

As shown in FIG. 3, in another embodiment, the hollow cylindrical dust collecting electrode is formed by connecting two dust collecting plates 20 respectively provided with a groove, which is preferably welding. A shape of the groove is a semicircle or a half of a polygon. The two dust collecting plates in the drawing are respectively provided with three semicircular grooves, and concave directions of the three semicircular grooves are the same, so that the two dust collecting plates are connected together to form three hollow cylindrical dust collecting electrodes. In addition, the gap between the dust collecting electrodes is filled with the patch plate.

According to the electric field device with an automatic cleaning function provided by the present invention, when the waste gas passes through the electric field device, the airflow may drive the wind wheel to rotate, and the wind wheel moves up and down along the corona pole while rotating, so that the wind wheel passes through the inside of the hollow cylindrical dust collecting electrode. At the moment, the dust sweeping device on the wind wheel follows the rotation of the wind wheel to clean the dust on the inner wall of the dust collecting electrode, in this way, the electric field device may further clean the dust on the inner wall of the dust collecting electrode in time while purifying the waste gas, so that the electric field device has the automatic cleaning function, without needing manual cleaning, thus saving time and costs, and having simple structure. In addition, changing the direction of the airflow passing through the electric field device can enable the wind wheel to move back and forth on the corona pole, so that the dust on the inner wall of the dust collecting electrode can be thoroughly cleaned. Compared with the method of cleaning by using a solution, the method has no secondary pollution and is beneficial to environmental protection. The wind wheel and the corona pore are matched by internal and external threads, and dust on the corona pole can be cleaned while the wind wheel moves up and down on the corona pole.

The detailed embodiments above are only used for illustrating the conception of the present invention, those of ordinary skills in the art may make various deformations and changes under the conception of the present invention, and these deformations and changes shall all fall within the protection scope of the present invention.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

The invention claimed is:

1. An electric field device with an automatic cleaning function, comprising:

a support;

at least one hollow cylindrical dust collecting electrode; and a corona pole placed on a central axis of the hollow cylindrical dust collecting electrode, wherein an end part of the corona pole is fixed on the support;

the hollow cylinder dust collecting electrode is grounded; and the corona pole is connected to a power source; and the electric field device with the automatic cleaning function further comprises a wind wheel; an axle hole of the wind wheel is provided with an internal thread; the corona pole is provided with an external thread matched with the internal thread on the wind wheel; and a periphery of the wind wheel is provided with a dust sweeping device in contact with an inner wall of the hollow cylindrical dust collecting electrode.

2. The electric field device according to claim 1, wherein the dust sweeping device is a brush or a scraper.

3. The electric field device according to claim 1, wherein the hollow cylindrical dust collecting electrode is a hollow circular cylinder dust collecting electrode or a hollow prismatic dust collecting electrode.

4. The electric field device according to claim 3, wherein one hollow cylindrical dust collecting electrode is arranged.

5. The electric field device according to claim 3, wherein two or more hollow cylindrical dust collecting electrodes are arranged, and at least one ends of the two or more hollow cylindrical dust collecting electrodes are connected into a whole through a patch plate.

6. The electric field device according to claim 1, wherein the hollow cylindrical dust collecting electrode is formed by connecting two dust collecting plates respectively provided with a groove.

7. The electric field device according to claim 6, wherein a shape of the groove is a semicircle or a half of a polygon.

8. The electric field device according to claim 2, wherein the hollow cylindrical dust collecting electrode is a hollow circular cylinder dust collecting electrode or a hollow prismatic dust collecting electrode.

9. The electric field device according to claim 8, wherein one hollow cylindrical dust collecting electrode is arranged.

10. The electric field device according to claim 8, wherein two or more hollow cylindrical dust collecting electrodes are arranged, and at least one ends of the two or more hollow cylindrical dust collecting electrodes are connected into a whole through a patch plate.

11. The electric field device according to claim 2, wherein the hollow cylindrical dust collecting electrode is formed by connecting two dust collecting plates respectively provided with a groove.

12. The electric field device according to claim 11, wherein a shape of the groove is a semicircle or a half of a polygon.

* * * * *